US010850499B2

(12) United States Patent
Sudermann

(10) Patent No.: US 10,850,499 B2
(45) Date of Patent: Dec. 1, 2020

(54) SLEEVE STATION

(71) Applicant: BOBST BIELEFELD GmbH, Bielefeld (DE)

(72) Inventor: Alexander Sudermann, Schloss Holte-Stukenbrock (DE)

(73) Assignee: Bobst Bielefeld GmbH, Bielefeld (DE)

( * ) Notice: Subject to any disclaimer, the term of this patent is extended or adjusted under 35 U.S.C. 154(b) by 149 days.

(21) Appl. No.: 15/925,837

(22) Filed: Mar. 20, 2018

(65) Prior Publication Data

US 2018/0272688 A1 Sep. 27, 2018

(30) Foreign Application Priority Data

Mar. 21, 2017 (EP) ..... 17020107

(51) Int. Cl.
*B41F 27/06* (2006.01)
*B41F 27/10* (2006.01)

(52) U.S. Cl.
CPC ..... *B41F 27/06* (2013.01); *B41F 27/105* (2013.01); *B41P 2227/20* (2013.01); *B41P 2227/21* (2013.01)

(58) Field of Classification Search
CPC ..... B41F 27/00; B41F 27/06; B41F 27/08; B41F 27/10; B41F 27/105; B41F 2227/20; B41F 2227/21; B41F 27/12; B41F 27/14; B41F 27/1206; B41F 27/1212
See application file for complete search history.

(56) References Cited

U.S. PATENT DOCUMENTS 2,707,530 A * 5/1955 Bromberg ..... B41F 3/46 187/255
3,146,709 A * 9/1964 Bass ..... B41C 1/182 101/375
3,625,145 A * 12/1971 Heatley, Jr. ..... B41F 9/00 101/142
4,461,663 A * 7/1984 Tachibana ..... B41F 27/105 101/375
4,823,693 A * 4/1989 Kobler ..... B41F 13/20 101/218
5,289,769 A * 3/1994 Lewis ..... B41F 27/12 101/218
5,878,666 A * 3/1999 Schneider ..... B41F 13/20 101/217

(Continued)

FOREIGN PATENT DOCUMENTS

DE 10102269 A1 8/2002
EP 0277545 A2 8/1988

OTHER PUBLICATIONS

European Search Report dated Sep. 26, 2017, in counterpart EP Patent Application No. EP 17020107 (5 pages, in English).

*Primary Examiner* — Matthew G Marini
*Assistant Examiner* — Marissa Ferguson-Samreth
(74) *Attorney, Agent, or Firm* — Bookoff McAndrews, PLLC

(57) ABSTRACT

A sleeve station dedicated to the assembly of a sleeve and a mandrel for a flexographic press. The sleeve station can be loaded manually, and assembles the sleeve with the mandrel in a vertical orientation when both are in a vertical orientation with aligned axes, avoiding problems caused by the bending of the sleeves during assembly. After loading of the sleeve, it is returned to a horizontal axis orientation.

7 Claims, 8 Drawing Sheets

(56) References Cited

U.S. PATENT DOCUMENTS

| | | | | |
|---|---|---|---|---|
| 6,973,875 | B2 * | 12/2005 | Gottling | B41F 7/12 101/463.1 |
| 7,290,488 | B2 * | 11/2007 | Petersen | B41F 27/105 101/375 |
| 7,331,288 | B2 * | 2/2008 | Gottling | B41C 1/05 101/216 |
| 8,141,239 | B2 * | 3/2012 | Rogge | B41F 13/00 101/477 |
| 2002/0129720 | A1 * | 9/2002 | Jendroska | B41F 13/00 101/216 |
| 2011/0283907 | A1 | 11/2011 | Plasswich et al. | 101/479 |
| 2017/0217156 | A1 * | 8/2017 | Puig Vil | B41F 13/0016 |

* cited by examiner

SLEEVE STATION

CROSS-REFERENCE TO RELATED APPLICATION

This application claims priority to European Patent Application No. 17020107.3, filed Mar. 21, 2017, the content of which is incorporated by reference herein.

FIELD OF THE INVENTION

This invention is related a module for replacement of a sleeve to be slipped on a mandrel for a rotary printing press. Further, the invention also relates to a method for assembling a sleeve with a mandrel.

BACKGROUND OF THE INVENTION

The invention is in the field of large rotary printing presses, for example flexogravure or heliogravure rotary printing presses. In particular, this invention refers to methods and devices for changing the rollers and more generally the so called "print job" of those machines. Rollers used in flexogravure or heliogravure rotary printing press tend to be massive and heavy. Their core is usually made of steel.

Whenever a print job changes, i.e. the image or the text to be printed is modified or changed, the roller or rollers also need to be changed.

To save costs and to make the replacement of the roller easier, a roller/mandrel and sleeve approach is used. Instead of an entire roller, a roller made of a mandrel and a sleeve is used, and for changing the print job only the sleeve has to be replaced. Therefore, it is known to provide sleeve stations where joining of the sleeve and adapter/mandrel is done.

The sleeve is lighter than a massive roller and thus easier to replace. Further, the material used to build the sleeve does not need to meet the stiffness requirements of a roller as a whole, which can lead to cost savings.

On small machines, with rollers that are on the order of 1 m width, sleeves can be changed manually. On bigger machines, with rollers wider than 1 m, it is convenient to automate the task of changing the sleeves to reduce the downtime. This can, however, be challenging, as when replacing the sleeve, the mandrel is held only by one of its ends, causing it to bend and oscillate due to its weight. The tolerance for the mounting of the sleeve being on the order of a few microns, so that this bending is not negligible and needs to be compensated.

Further, as a free end of the mandrel is moved, for example when removing a sleeve, or in the operation of releasing the tip when removing the sleeve, the mandrel tip starts to oscillate. Thus, it is necessary to wait until this oscillation ends before replacing the sleeve, which adds further to the overall downtime of the rotary printing press.

US 2011/0283907 discloses a sleeve replacement system where a robot fetches a sleeve from a storage device and mounts it on a mandrel which is fixed horizontally in the rotary printing press. The system requires ad-hoc position sensors and a continuous monitoring of the tip of the mandrel and sleeve to compensate the effects of gravity that cause the bending and oscillation of the sleeve and the mandrel.

OBJECT AND SUMMARY OF THE INVENTION

An object of this invention is to provide a method and a module to replace the sleeves of a rotary printing press by limiting the drawbacks of the prior art. Another object of the invention is to provide a sleeve station which is separate from the press and which can be used with a large variety of printing presses already available in the market. It is a further object of the invention to assemble, in a simple and automated manner, a sleeve with a mandrel (or an adapter), suitable for large sleeve lengths.

According to the invention, these aims are achieved by means of a method, a sleeve station and a module according to the disclosure herein.

According to one aspect, the invention relates to a module for replacement of a sleeve to be slipped on a mandrel for a rotary printing press, comprising a sleeve gripper, a mandrel gripper and a linear guide wherein, in a replacement position, a revolution axis of the sleeve coincides with a revolution axis of the mandrel defining an assembly axis. The linear guide is engaged with at least one of the sleeve gripper and/or the mandrel gripper, and the linear guide is configured to translate the sleeve gripper and/or the mandrel gripper substantially along the assembly axis. The orientation of the assembly axis is according to the invention substantially perpendicular to a revolution axis of the sleeve in a printing mode.

In particular, the arrangement of the sleeve in a substantially vertical direction was found to be advantageous according to one aspect of the invention. Vertical according to the invention should be understood as the roll axis being in the direction of gravity. This vertical also corresponds to a direction of the roller axis of the roller comprising at least a sleeve substantially perpendicular to the roller axis in operation during printing. By using such an arrangement of the sleeve and therefore also the mandrel, bending of the sleeve and its possible related oscillations that impair the assembly of large sleeves can be largely diminished.

According to a preferred embodiment, the module further comprises a motor for moving the linear guide.

Good results could be achieved, if the sleeve gripper is connected to a first pivot for pivoting the sleeve at least between an orientation of the assembly axis and an orientation of delivery, whereas preferably, a rotation axis of the first pivot is perpendicular to the assembly axis.

Preferably, the mandrel gripper is connected to a second pivot for pivoting the mandrel at least between the orientation of the assembly axis and the orientation of delivery; whereas preferably a rotation axis of the second pivot is perpendicular to the assembly axis.

Further to this it might be advantageous that the sleeve gripper comprises a central stem for carrying the sleeve, a first clamp element, a second clamp element and a third clamp element, wherein at least one of the clamp elements is arranged to move toward the central stem up to a position where the sleeve is gripped by the first, second and third clamp element, whereby the revolution axis of the sleeve is in parallel to the axis of the stem.

According to a yet further preferred embodiment of the invention, the stem comprises centering means.

According to another aspect, the invention relates to a method for assembling a sleeve with a mandrel, comprising the steps of gripping the sleeve with a sleeve gripper; gripping the mandrel with a mandrel gripper; aligning the revolution axis of the sleeve with the revolution axis of the mandrel in a direction substantially perpendicular to a revolution axis; and slipping the sleeve over the mandrel by translating the sleeve and/or the mandrel substantially along the direction of the assembly axis.

According to another aspect, the invention relates further to a method for assembling a sleeve with a mandrel, comprising the steps of slipping the sleeve over a stem in a delivery orientation; assembling the sleeve with the mandrel according to the method as described above; pivoting the assembled mandrel and sleeve back into the delivery orientation; and opening the sleeve gripper to release the assembled sleeve.

Preferably a sleeve station comprises one or several modules as described above and such a sleeve station is operated separately and independent from any printing machine.

DESCRIPTION OF THE DRAWINGS

The invention will now be explained with reference to several embodiments which are shown in the attached drawings.

In the figures, the frame is sometimes partially represented to show the other elements of the station better.

DETAILED DESCRIPTION OF POSSIBLE EMBODIMENTS OF THE INVENTION

This section describes in details some possible variations for implementing the invention followed by specific examples of embodiments. Unless stated otherwise, each paragraph in this section may refer to a different aspect of the invention; in other words, the features disclosed in distinct paragraphs may be used in distinct embodiments. Nevertheless, the features disclosed in distinct paragraphs may also be used in combination with the features disclosed in other paragraphs.

Figure 1:
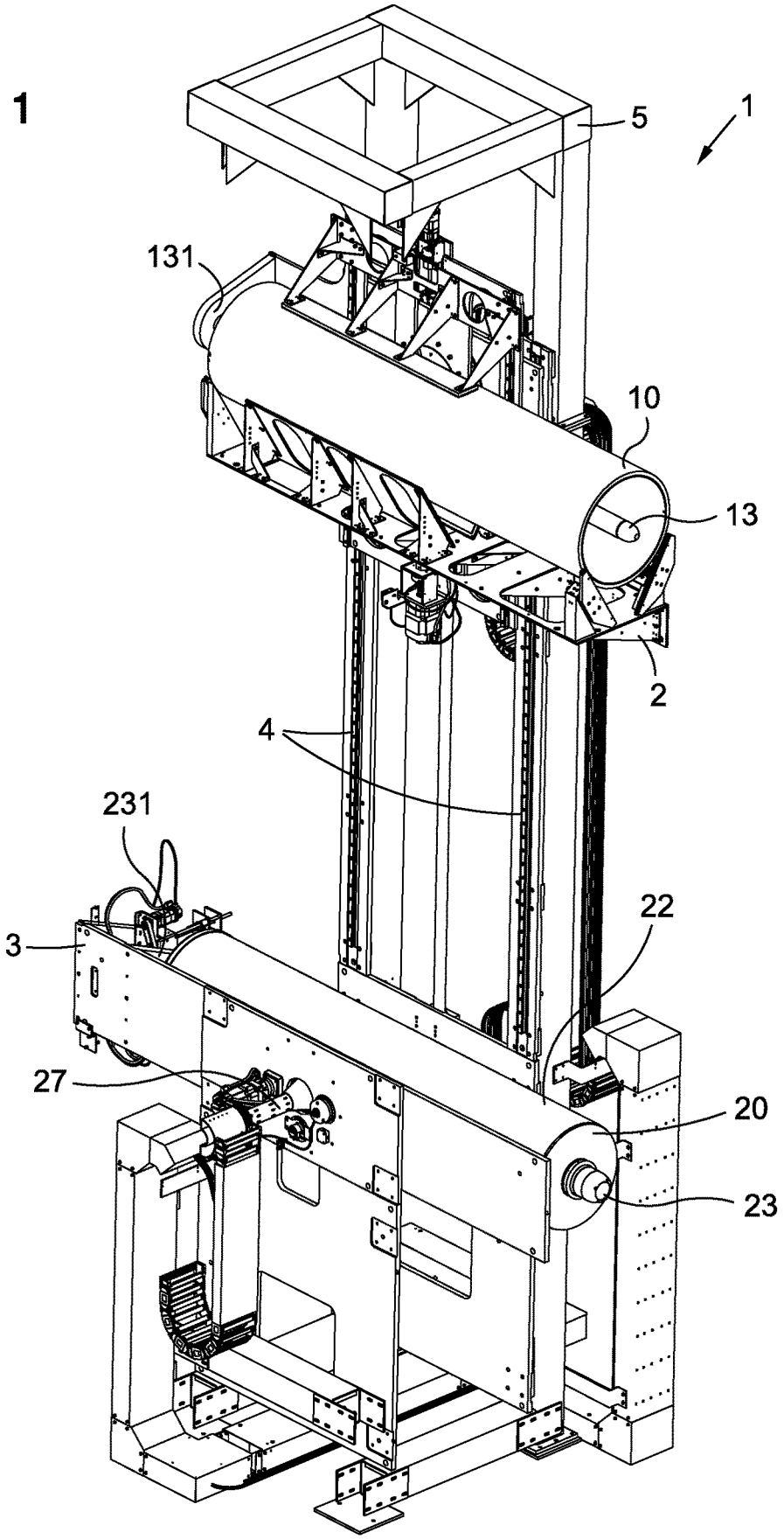
FIG. 1 shows an example of sleeve station according to a preferred embodiment of the invention with a sleeve and a mandrel in a loading position; each gripped by its respective gripper.
Figure 3:
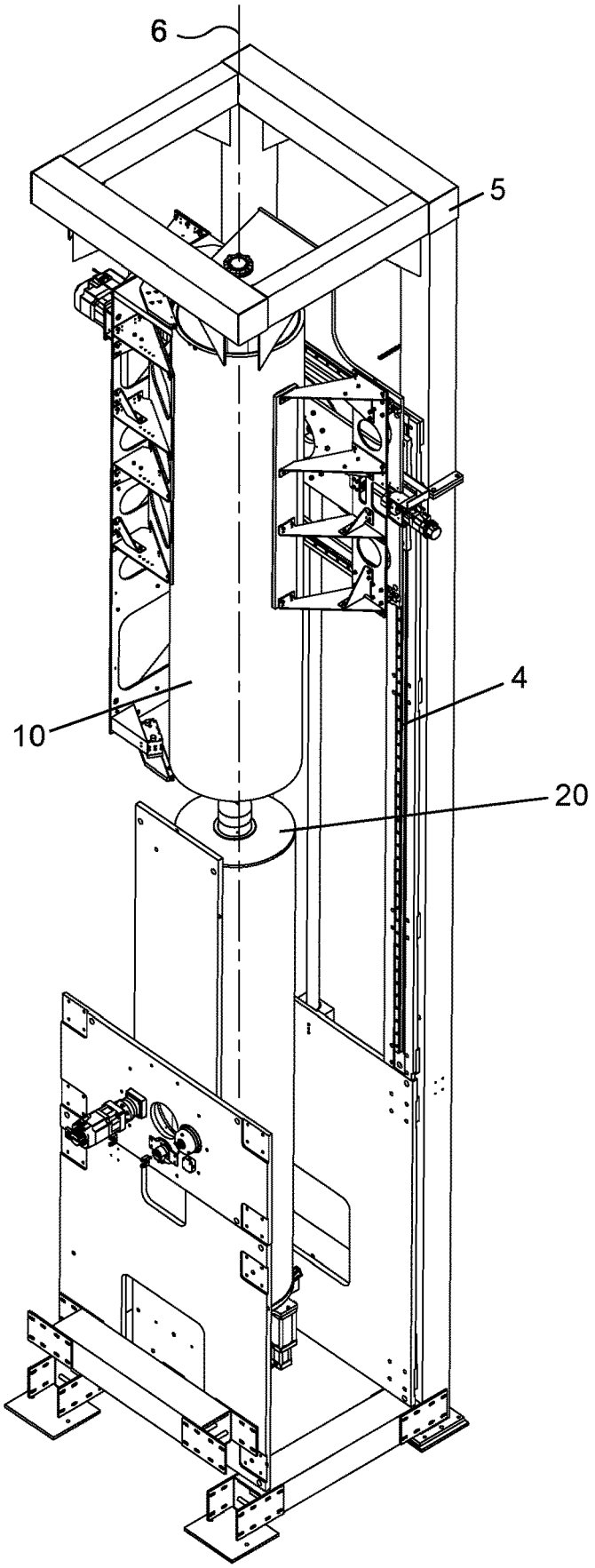
FIG. 3 shows the sleeve station with the sleeve and mandrel oriented according to the assembly axis, and ready for assembly.

FIG. 1 shows an embodiment of the sleeve station 1 according to the invention. A frame 5 (partially represented in the Figures) holds a sleeve gripper 2 and a mandrel gripper 3. The mandrel 20 is sometimes called an adapter since, in the majority of cases, the mandrel 20 is a hollow structure that is mountable on a shaft 23 in a press. Once a sleeve 10 is gripped by the sleeve gripper 2, and a mandrel 20 is gripped by the mandrel gripper 3, as shown in FIG. 3, the unit aligns the sleeve with the mandrel so that their revolution axes coincide. This can be achieved, by pivoting the mandrel 20 and/or sleeve 10 in the sleeve station 1. FIG. 1 shows the mandrel 20 and the sleeve 10 in the sleeve station in a loading orientation.

Figure 4:
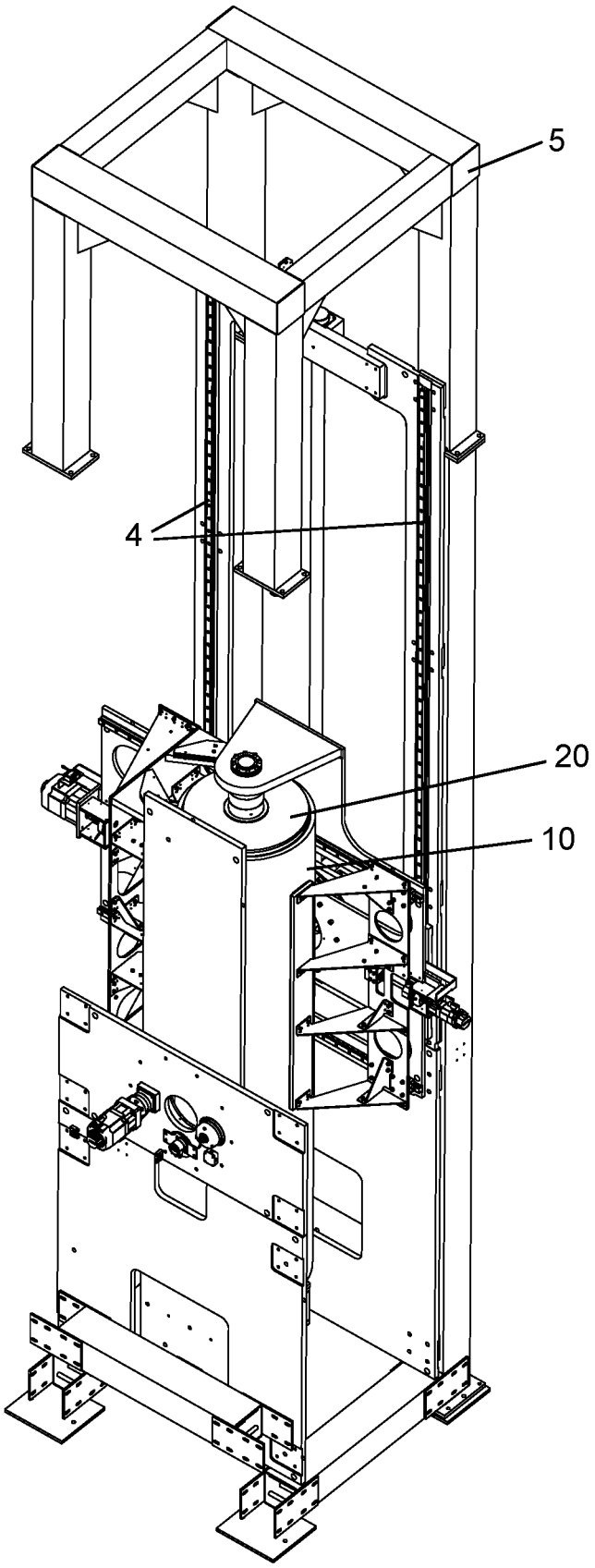
FIG. 4 shows the sleeve station of FIG. 3 after assembly.

The aligned revolution axes define an assembly axis 6, as shown in FIG. 3. In this position the sleeve 10 is, according the preferred embodiment shown in FIGS. 3 and 4, assembled with the mandrel 20 by a relative linear motion of the sleeve 10 and/or the mandrel 20 along the assembly axis operated by a linear guide 4. The assembly axis is chosen to be vertical, which means according to the invention an axis substantially perpendicular to an operation axis of the roller in a rotary printing press. The direction of the assembly axis is therefore substantially in direction of gravity.

The so called vertical aspect of the assembly axis leads to the advantage that the sleeve is prevented from bending, and consequently also prevents the tip of the sleeve oscillating around a bending position. The lack of bending and/or oscillations leads to a system which can effect changing of a sleeve in less time and with less complexity.

With a module according to the invention the need for measuring the bending can be prevented. Further oscillations are diminished and therefore time to reach stable conditions to perform the assembly is much shorter. The system as proposed can be implemented as an open loop system, even if the use of positioning sensors is preferred. Positioning sensors double check on the relative positioning of the sleeve and mandrel prior to the assembly. The sleeve station is configured for assembly and disassembly of the sleeves and the mandrel.

Figure 2:
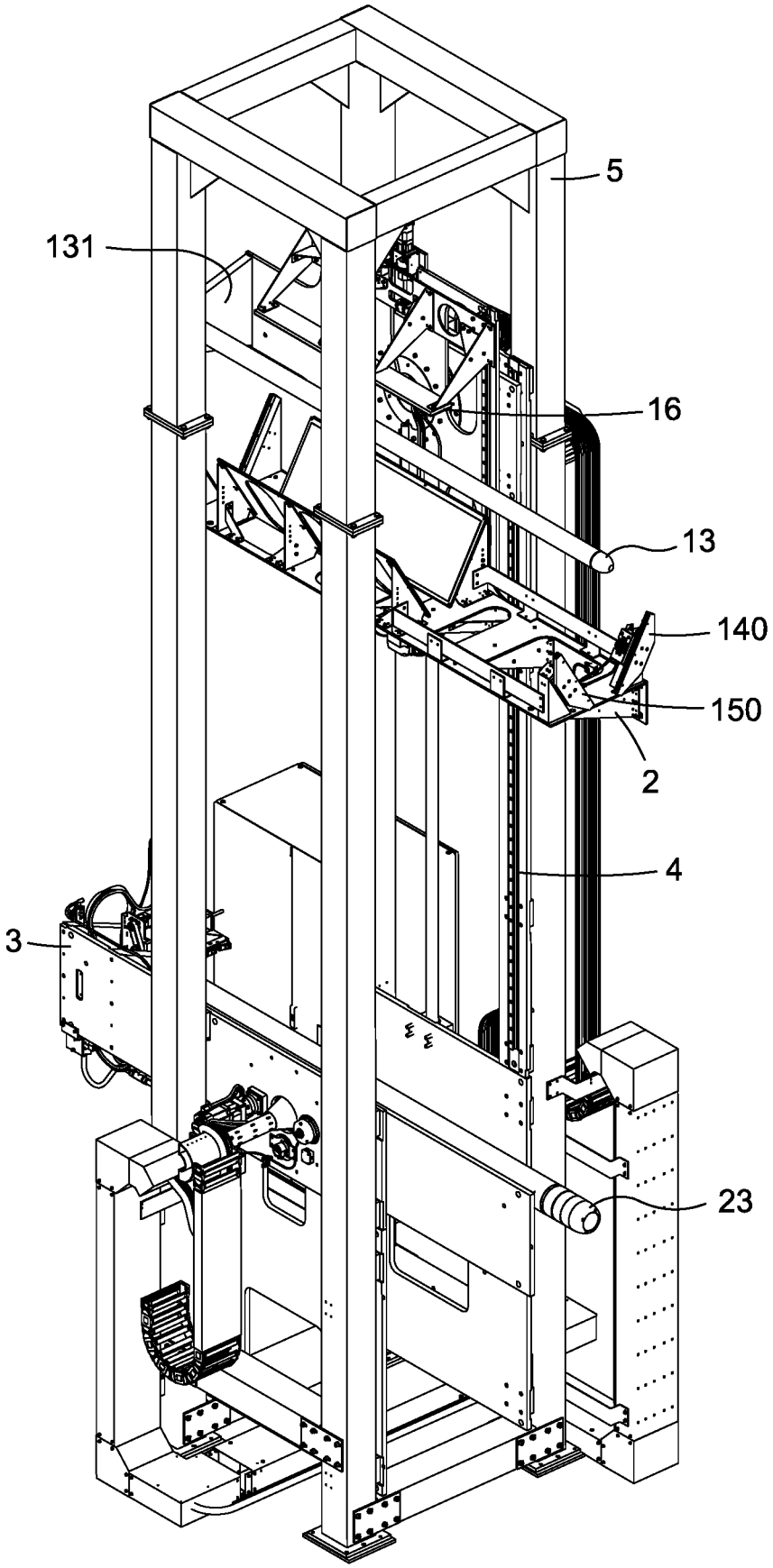
FIG. 2 shows an empty sleeve station without the sleeve or the mandrel.

The linear guide 4 mechanically guides the mandrel gripper 3 and the sleeve gripper 2 in an engaged position. In the example in FIGS. 1 to 4, the linear guide indirectly connects the two grippers in the sense that the linear guide 4 holds the sleeve gripper 2 and is mounted on the frame 5. The mandrel gripper 3 is fixed to the frame 5, but on the opposite side of the frame (represented in FIG. 2 but not represented in FIG. 1). Thus, the linear guide is indirectly mechanically connected to the mandrel gripper 3 through the frame 5. The linear guide can be operated by an electric motor, which allows careful control of the position, speed and force with which the sleeve and mandrel are assembled. Other activation of the linear guide is also possible, e.g. hydraulic, pneumatic, etc.

The linear guide 4 can be connected to the sleeve gripper 2, to cause the motion of the sleeve gripper 2, as shown in the pictures. This is the preferred solution because the sleeve is lighter than the mandrel, which is kept fixed and below the sleeve.

In another embodiment, the linear guide 4 is connected to the mandrel gripper and causes the mandrel to move toward and away from the sleeve to perform the assembly or disassembly of the printing roller. In another embodiment, the linear guide 4 is connected to the mandrel gripper and the sleeve gripper and moves both the mandrel and the sleeve toward and away from each other to perform the assembly and the disassembly.

For ergonomic reasons, the sleeve is inserted on a stem 13 which is preferably oriented horizontally. The assembly orientation is the orientation of the sleeve gripper when the sleeve rotation axis is aligned with the assembly axis and the loading orientation if the orientation of the sleeve gripper 2 when the stem 13 is oriented for loading and unloading the sleeve 10.

In the loading orientation, the stem 13 of the sleeve gripper can be slightly tilted, preferably so that the sleeve slides to the back of the stem. For example, it can be set to −5 degrees from the horizontal, the negative sign representing a slope may cause the sleeve 10 to slide, or at least stay, toward the back 131 of the stem 13. In the loading orientation, the stem 13 may be positioned at an angle ranging from +5 degrees to −30 degrees.

The sleeve gripper is connected to a first pivot 17 (FIG. 5), which is configured to rotate the sleeve gripper from the loading orientation to the assembly orientation (and back) about a first pivoting axis which is preferably perpendicular to the assembly axis. The first pivoting axis is not required to be perpendicular to the assembly axis; it suffices that it is able to rotate the sleeve gripper from the loading orientation to the assembly orientation and back. To do so, it suffices that first pivoting axis has a non-zero component along the perpendicular to the assembly axis.

The assembly axis is preferably vertical to avoid the bending of the sleeve and the oscillation mentioned earlier in the description. However, the system is expected to work also if the assembly axis departs from the vertical, as defined above, orientation from −10 to +10, preferably −5 to +5 degrees.

Figure 5:
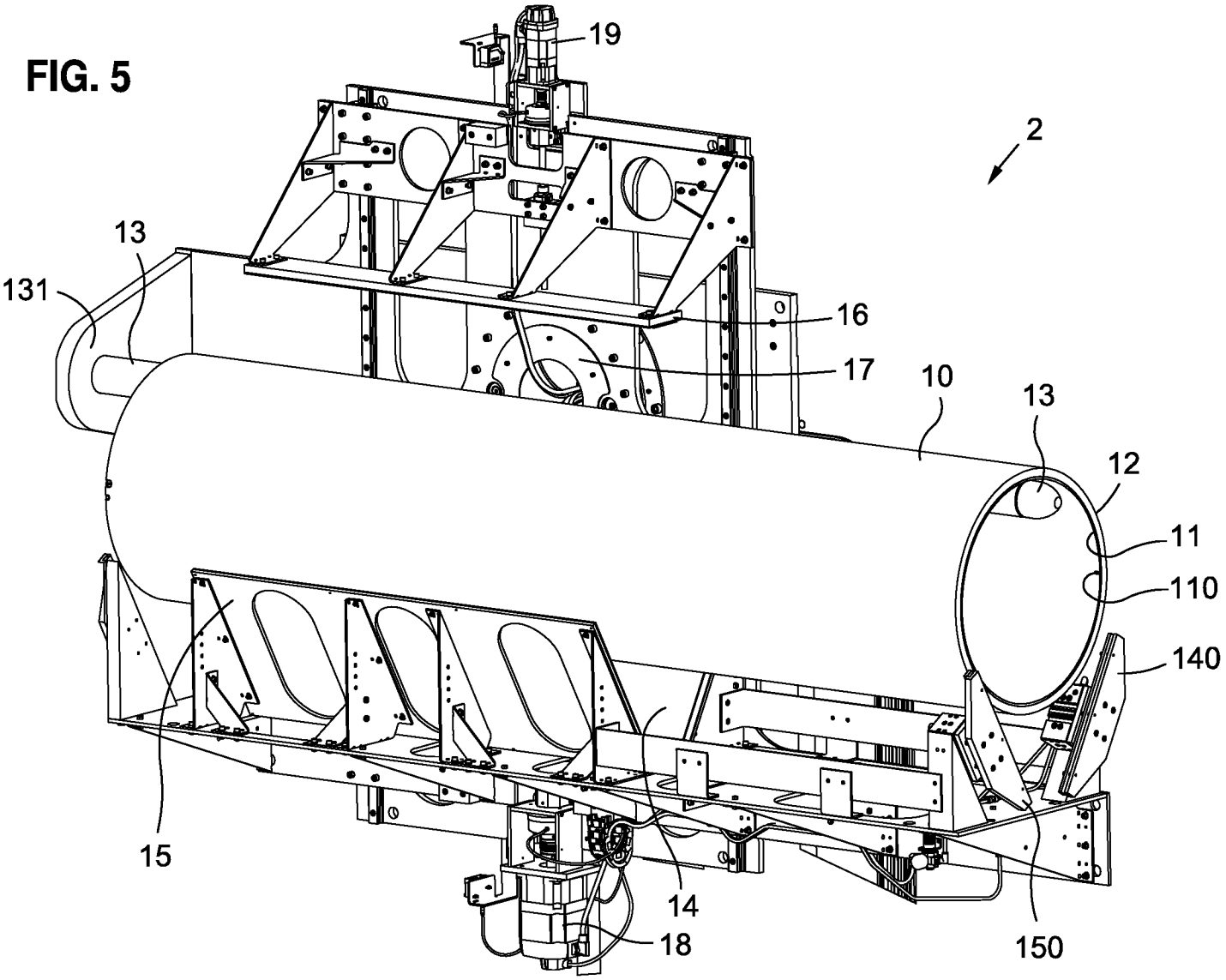
FIG. 5 shows a detailed embodiment of the sleeve gripper.

In FIG. 5, the sleeve gripper comprises a stem 13 and three clamp elements 14,15,16. The clamp elements grip the sleeve 10, while the stem 13 holds the sleeve 10 when the sleeve 10 is not yet gripped. The sleeve 10 is put on the stem 13 of the sleeve gripper 2 while the gripper is in an open position. An open position is one where the distance between the clamp elements 14,15,16 is large, for example as depicted in FIG. 5. By large, we mean large enough to insert the sleeve 10 on the stem 13 without interfering with the clamp elements. To grip the sleeve, the clamp elements are driven toward each other until the sleeve 10 is clamped. Preferably, while the stem is in loading orientation, the two clamp elements 14 and 15 are fixed with respect to each other and are driven upwards toward the clamp element 16, by the motor 18. The position of the clamp element 16 is selected as a function of the sleeve diameter. Advantageously, a motor is used to adjust its position, so that when it is gripped, the sleeve rotation axis is aligned with the axis of the stem 13, or aligned to any arbitrary axis chosen to be at a fixed location with respect to the sleeve gripper (and not depending on the sleeve diameter). The position of the clamp element 16 is only changed with a varying sleeve (outer) diameter. Thus, in a situation where that diameter almost never changes, it can be advantageous to replace motor by a device that is operated by hand, for example, a translation device operated by a screw.

According to a preferred embodiment the stem 13 may comprise centering means.

To ensure a proper gripping, but without deforming the sleeve, the clamp elements are either positioned at a predefined location which depends on the sleeve diameter or using a pressure sensor on at least one of the clamp elements. Preferably, the parameters of the sleeve and mandrel (diameter, length, thickness, weight) are loaded into the sleeve station electronics prior to the assembly or disassembly. In a preferred embodiment, the sleeve and the mandrel comprise a code, which is read by the machine, to determine the parameters without the user intervention. In some embodiments, instead of a code, the values of the parameters themselves are stored in, or on, the sleeve or mandrel.

In a preferred embodiment, before the sleeve is gripped, a device comprised of arms 140,150 ensures that the sleeve is positioned against an abutment positioned toward the back 131 of the sleeve gripper (not shown). In a preferred embodiment, this device is implemented using two arms 140 and 150, which have ends that are parallel to the surface of clamp elements 14 and 15, respectively, slightly shifted toward the inside (as depicted in FIG. 5). In this way, the arms 140 and 150 act as an abutment for the sleeve 10. The arms are configured to move along parallel to the stem and to push the sleeve to the back of the sleeve gripper.

Instead of using arms 140 and 150 to push the sleeve toward the back, the mandrel gripper can use the pivot to orient the sleeve gripper in a steep orientation, with the back 131 of the stem at the bottom, clamp the sleeve, and then turn the gripper toward the assembly orientation. The orientation can range, for example from 30 to 60 degrees from the vertical, to ensure that the sleeve slides against an abutment positioned toward the back 131 of the stem and that the sleeve touches both clamp elements 14 and 15 during the whole clamping operation.

In FIG. 1, the mandrel gripper 3 comprises a second pivot 27 configured to rotate the mandrel 20 (gripped in the mandrel gripper) from a loading orientation to the assembly orientation and back. The loading orientation of the mandrel gripper 3 has the same characteristics as the loading orientation of the sleeve gripper and is preferably identical to the loading orientation of the sleeve gripper. Thus the orientation of the pivoting axis of the second pivot followed the same constraints as the orientation of the pivoting axis of the first pivot. The second pivot is preferably fixed to the frame 5 of the sleeve station.

The mandrel gripper comprises an inlet for pressurized air. This pressurized air is transmitted to the mandrel through a pipe (not represented), either through the stem 23 holding the mandrel or on the back 231 of the stem. The air exits the front of the mandrel through an ad hoc pipe in the mandrel itself. This air creates an air cushion between the mandrel and the sleeve which allows the sleeve to slide over the mandrel for assembly or disassembly. The air pressure in the current embodiment is of the order of 6 to 10 bars. When the air is stopped, then the sleeve is tightly connected to the mandrel, either only through pressure and friction, or with the help of an adhesive layer 110 placed in the inside 11 of the sleeve 10, or on the surface 22 of the mandrel.

The mandrel gripper 3 comprises means for holding the mandrel 20, for example from the inside using a stem 23. In systems using mandrels 20 that have a shaft, the mandrel gripper grips the mandrel by the shaft. In a preferred embodiment, when the sleeve is assembled on the mandrel, the stem 13 of the sleeve gripper is inserted into the stem 23 of the mandrel gripper.

According to a preferred embodiment the sleeve and the mandrel have a registered rotation orientation. In other words, the relative orientation of the sleeve and mandrel according to a rotation along the revolution axis must be known. The mandrel and sleeve may be assembled in an arbitrary orientation, and their relative rotation orientation may then be measured, for example by using a camera and some markings on the border of the sleeve and mandrel.

Advantageously, the sleeve is assembled in a well-defined rotation orientation relative to the mandrel. To do so, a positioning slot is provided on the sleeve, and a corresponding protrusion is provided on the mandrel (not shown). Then, either the sleeve gripper 2 or the mandrel gripper 3 may be provided with means for rotating around the revolution axis during or before assembly. Preferably, the mandrel gripper is equipped with such means, for example using a motor that rotates the mandrel about its revolution axis. Thus, once the relative rotation orientation of both the sleeve and the mandrel is known, then the motor is used to set the orientation accordingly so that the positioning slot is aligned with the protrusion. Finally, the protrusion is inserted into the slot.

The position of the positioning slot can be measured using a camera or a laser sensor. The positioning of the corresponding protrusion on the mandrel can also be measured with a camera or a laser sensor (any other marking on the mandrel can be used to measure the orientation as long as the position of the protrusion is well defined with respect to said marking). The rotation orientation of the mandrel may also be set by the operator when loading the mandrel on the stem 23. In the latter case, the position of the protrusion does not need to be measured.

Except for the rotation orientation setting (when required), the sleeve station can work in open loop. However, to prevent from destroying a sleeve when one of the positioning element is less precise than expected due to some error or wearing over time, a set of positioning sensors can be used for

- Measuring the alignment on the assembly axis of the sleeve and of the mandrel
- Measuring the distance between the sleeve and the mandrel during assembly, and measuring the relative position of the sleeve over the mandrel to ensure proper final positioning.
- Measuring the vertical position of the sleeve on the sleeve gripper in the loading orientation.

To assemble the sleeve with a mandrel to obtain a printing cylinder or printing roller, we apply the following method that comprises the steps of:

- gripping the sleeve 10 with a sleeve gripper 2,
- gripping the mandrel 20 with a mandrel gripper 3,
- aligning the revolution axis of the sleeve 10 with the revolution axis of the mandrel 20 and with the vertical direction, and
- slipping the sleeve 10 over the mandrel 20 by translating the sleeve 10 or the mandrel 20 along the vertical direction.
- Then, unclamping the sleeve, and translating back the sleeve gripper toward the position and orientation it started with (in other words, introducing some distance between the sleeve gripper and the mandrel gripper).
- Orienting the sleeve-mandrel assembly (i.e. the printing roller) into the loading orientation.
- Removing the ready-to-use printing roller.

Prior to the above-mentioned method, the sleeve and mandrel have to be loaded into the station. To do so, the sleeve gripper and mandrel gripper are oriented according to the loading position. The sleeve is (manually) slipped over the stem 13 of the sleeve gripper (the operation is manual unless the whole transfer from the sleeve station to the printing machine is automatized as well with a separate system).

Prior to the assembly of a sleeve with a mandrel, and to allow the handling of sleeve/mandrel assemblies with varying sizes, the dimensional parameters of the sleeve and the mandrel are loaded in the electronics of the sleeve station. The dimensional parameters comprise the sleeve outer diameter and the sleeve (and mandrel) length. The parameter may comprise many more parameters as well, like for example material types, which would influence the speed or forces at stake, the air pressure to be applied, the size of the slot, etc.

In the method, the chronological order of the steps of a process is defined when the steps, or group of steps, are separated by the word "then". If not, the order can be reversed, or the steps can be performed in parallel. By vertical orientation, we mean a parallel to the gravitational force direction.

Figure 6A:
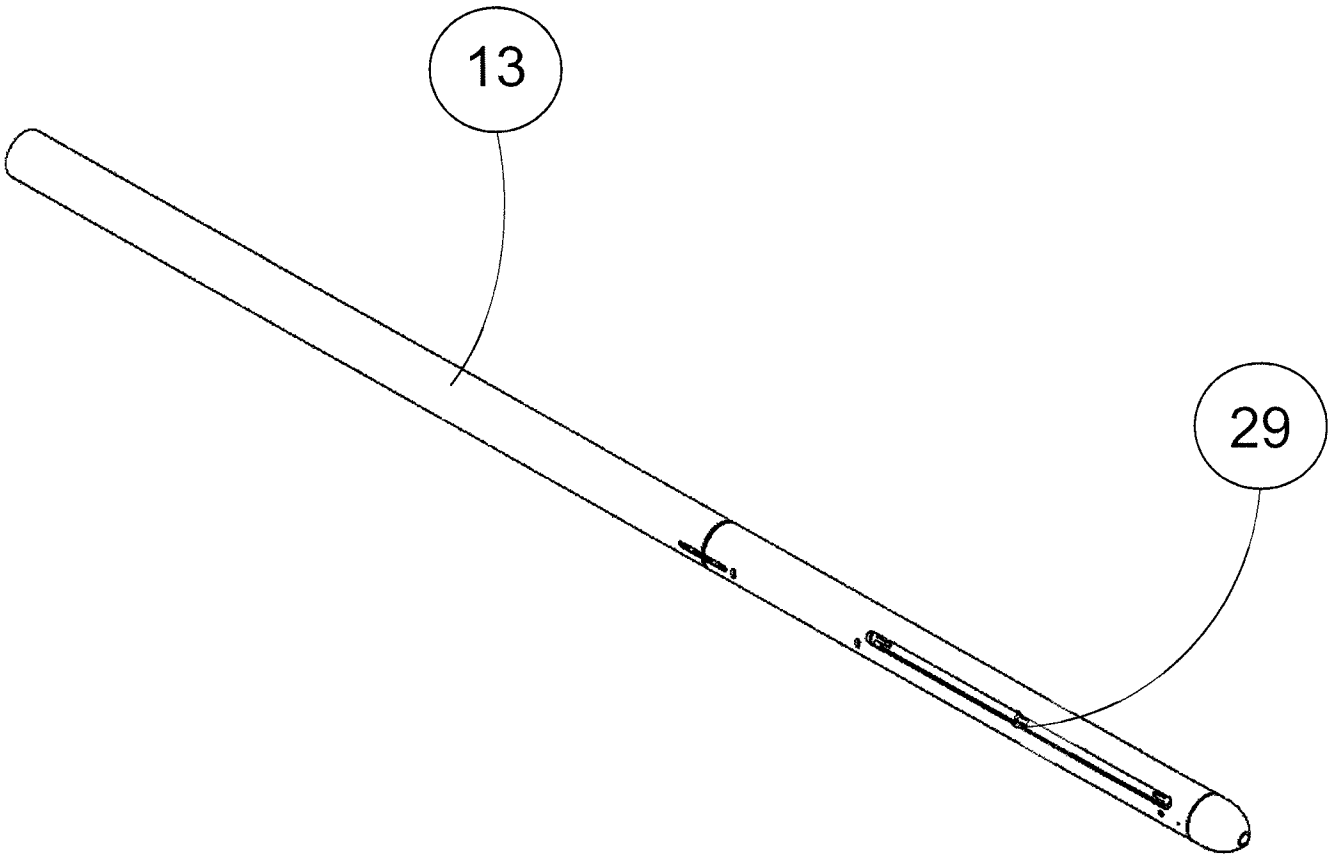
FIG. 6A shows a stem according to a preferred embodiment with retracted centering means.
Figure 6B:
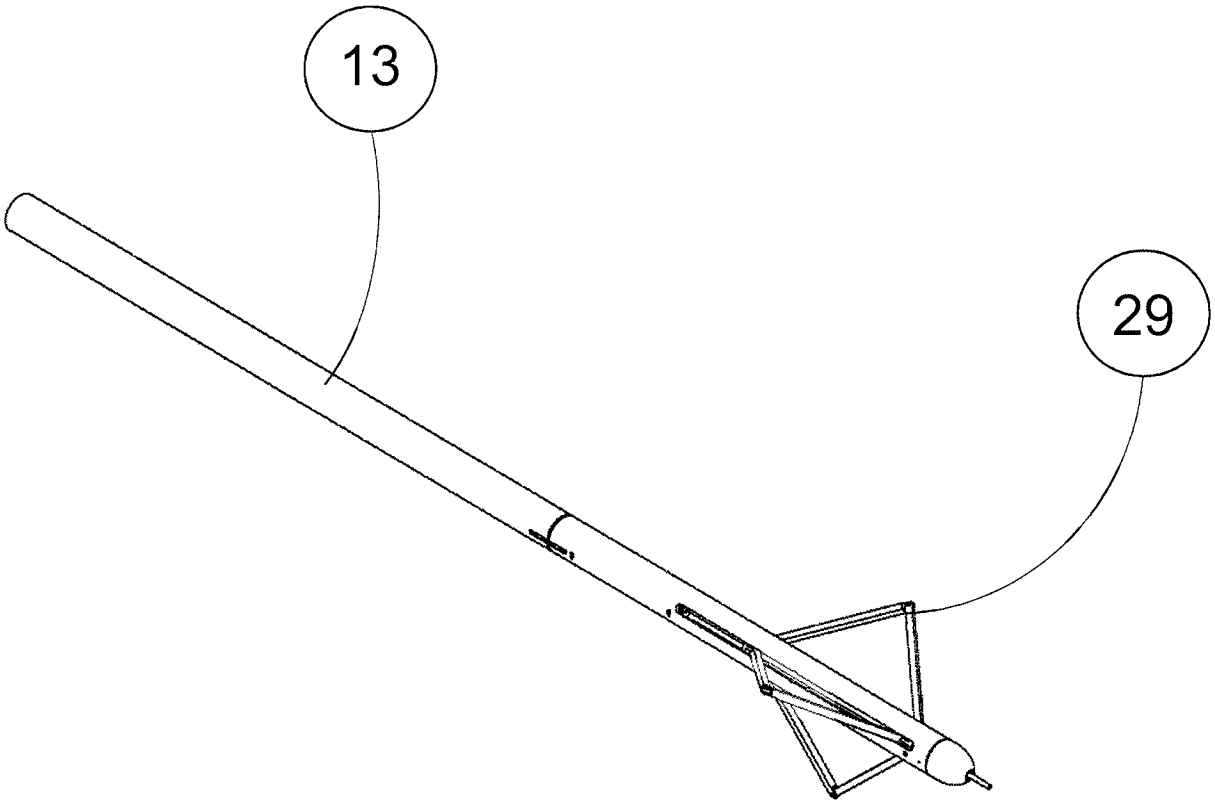
FIG. 6B shows the stem with centering means extended.
Figure 6C:
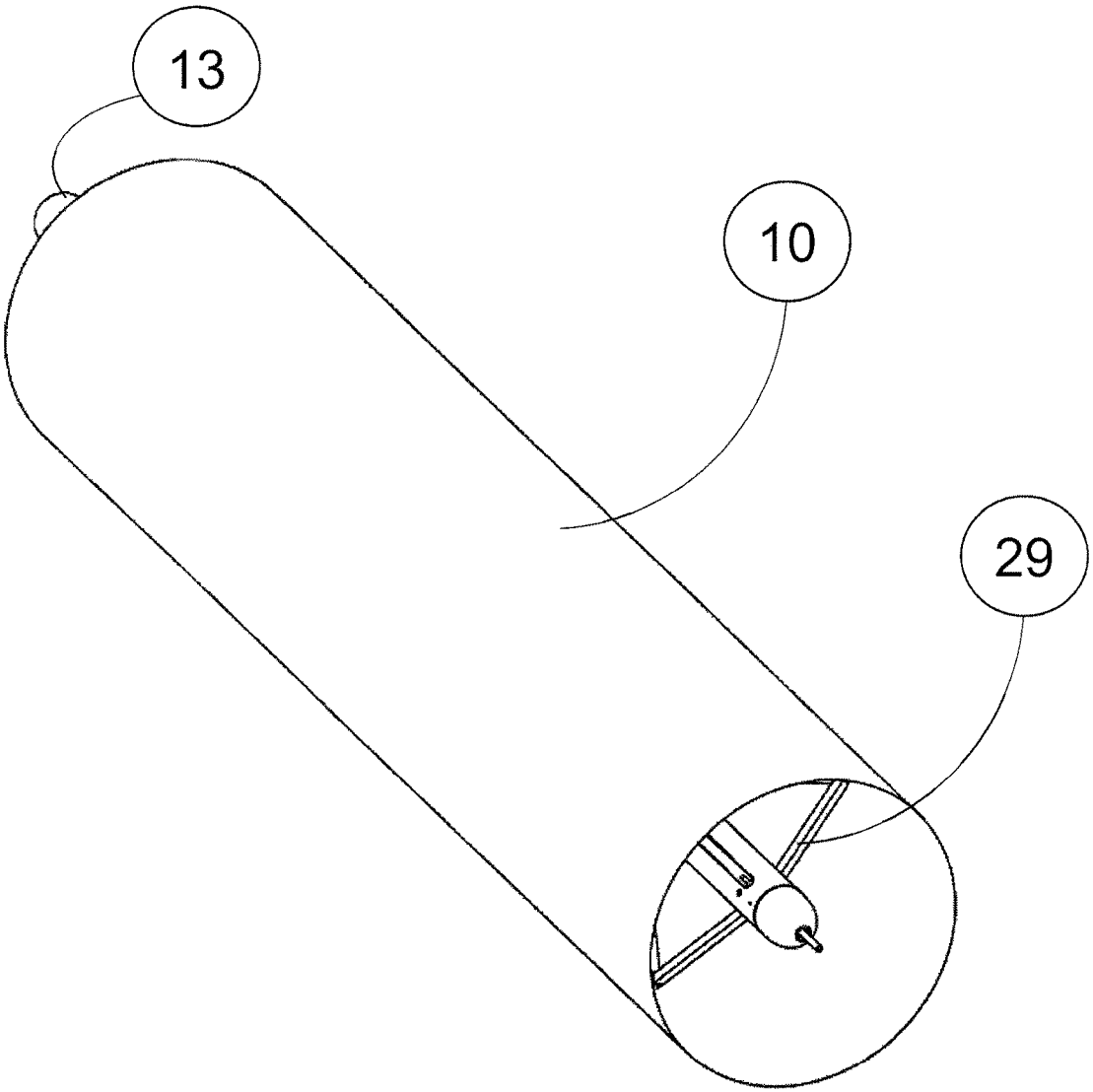
FIG. 6C shows the stem of FIG. 6B installed in a sleeve.

FIGS. 6A, 6B and 6C show a stem 13 with a centering means 29. The centering means 29 according to this embodiment are retractable and in a retracted position included in the stem 13 (see FIG. 6A). In an extended position (see FIG. 6B) the centering means 29 can be extended to a position, e.g. to fit the inner diameter of the sleeve 10 (FIG. 6C).

The activation can be effected by all means accessible to the person skilled in the art. This can be for example a pneumatic, hydraulic, mechanic or electric activation.

The centering means 29 provide a supplemental centering from the "inside". The clamp elements 14, 15 and 16 create a centering from the "outside". As soon as a first part of the sleeve 10 is slipped on the mandrel 20, the centering means 29 might not be necessary anymore and therefore could be retracted, as then the guidance is given by the mandrel 20 and the sleeve 10 themselves.

REFERENCE NUMERALS

Sleeve station 1
Sleeve gripper 2
Mandrel gripper 3
Linear guide 4
Frame 5
Assembly axis 6
Assembly motor 7
Sleeve 10
Sleeve interior side 11
Sleeve exterior side 12
Central stem 13
First clamp element 14
Second clamp element 15
Third clamp element 16
Sleeve gripper pivot 17
Pivoting motor 18
Positioning slot
Mandrel 20
Mandrel stem 23
Mandrel gripper pivot 27
Centering means 29
Back of the stem holding the sleeve 131
Arm to hold the sleeve 140
Arm to hold the sleeve 150
Back of the stem holding the mandrel 231

The invention claimed is:

1. A module for replacement of a sleeve to be slipped on a mandrel for a rotary printing press, the module comprising, a sleeve gripper configured to secure the sleeve;

a mandrel gripper configured to secure the mandrel; and a linear guide, wherein the mandrel gripper is configured to rotate, while securing the mandrel, from a sleeve replacement position, in which a revolution axis of the sleeve coincides with a revolution axis of the mandrel, together defining an assembly axis, to a delivery position in which the mandrel is transverse to the assembly axis; and the linear guide is engaged with at least one of the sleeve gripper and the mandrel gripper; and the linear guide is configured to translate the at least one of the sleeve gripper and the mandrel gripper substantially along the assembly axis, wherein the module is configured to position the mandrel with the sleeve to a printing position for a printing mode such that the revolution axis of the sleeve is substantially perpendicular to the assembly axis.

2. The module according to claim 1, further comprising a motor for moving the linear guide to move at least one of the sleeve gripper and the mandrel gripper relatively to the other of the sleeve gripper and the mandrel gripper.

3. The module according to claim 1, wherein the sleeve gripper is connected to a first pivot configured for pivoting the sleeve at least between an orientation of the assembly axis and an orientation of delivery, wherein a rotation axis of the first pivot is perpendicular to the assembly axis.

4. The module according to claim 3, wherein the mandrel gripper is connected to a second pivot for pivoting the mandrel at least between the orientation of the assembly axis and the orientation of delivery;

wherein a rotation axis of the second pivot is perpendicular to the assembly axis.

5. The module according to claim 3, wherein the sleeve gripper comprises a central stem positioned in the sleeve for carrying the sleeve, a first clamp element, a second clamp element and a third clamp element, wherein at least one of the clamp elements is configured to move toward the central stem up to a position where the sleeve is gripped by the first, second and third clamp elements, whereby the revolution axis of the sleeve is in parallel to the axis of the stem.

6. The module according to claim 5, wherein the stem comprises a centering device for centering the sleeve on the stem.

7. A sleeve station comprising one or several modules according to claim 1, wherein the sleeve station is operated separately and independently from any printing machine.

* * * * *